US006347716B1

(12) United States Patent
Nofer et al.

(10) Patent No.: US 6,347,716 B1
(45) **Date of Patent: *Feb. 19, 2002**

(54) FLIP TOP CAP WITH TAMPER EVIDENT FLAP

(75) Inventors: Karl H. Nofer; Jozef Krajnc, both of Kitchener (CA)

(73) Assignee: Pano Cap (Canada) Limited, Kitchener (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/134,934

(22) Filed: Aug. 17, 1998

(51) Int. Cl.[7] ..... B65D 51/18; B65D 47/08; B65D 47/10

(52) U.S. Cl. ..... 215/235; 215/237; 215/253; 215/330; 220/259; 220/266; 220/833; 220/847; 222/153.06; 222/541.5; 222/541.6; 222/556

(58) Field of Search ..... 215/235, 237, 215/250, 253, 254, 258, 330; 220/254, 257, 258, 259, 266, 270, 279; 222/153.06, 153.14, 153.07, 541.5, 541.9, 556, 568, 564, 547

(56) References Cited

U.S. PATENT DOCUMENTS 4,487,324 A * 12/1984 Ostrowsky ..... 215/253
4,782,964 A * 11/1988 Poore et al. ..... 215/237 X
5,052,572 A * 10/1991 Pherigo ..... 220/266 X
5,094,357 A * 3/1992 McKinney ..... 215/253 X
5,108,029 A * 4/1992 Abrams et al. ..... 220/266 X
5,141,138 A * 8/1992 Odet et al. ..... 222/556 X
5,143,234 A * 9/1992 Lohrman et al. ..... 215/235
5,145,080 A * 9/1992 Imbery, Jr. ..... 215/330
5,201,440 A * 4/1993 Gross ..... 215/254 X
5,386,918 A * 2/1995 Neveras et al. ..... 215/235
5,392,938 A * 2/1995 Dubach ..... 215/254
5,662,245 A * 9/1997 Grant ..... 220/254 X
5,676,270 A * 10/1997 Roberts ..... 215/330
5,799,840 A * 9/1998 Mogard ..... 220/259 X
5,806,698 A * 9/1998 Aguirrezabal ..... 215/235
5,875,907 A * 3/1999 Lay ..... 215/253

* cited by examiner

*Primary Examiner*—Nathan J. Newhouse
(74) *Attorney, Agent, or Firm*—Daryl W. Schnurr

(57) ABSTRACT

A flip top closure has a tamper evident flap and is used on a container with a neck and an opening therein. the neck has an outer surface with retaining means for the closure thereon. The closure has two sections that are hinged to one another and with each section having a lip extending along an edge thereof. When the closures are in a closed position, the two lips form a continuous line of contact with one another and a flap extends across the line of contact. The flap is connected to one section by ultrasonic spot welding. The flap is severable from either or both sections. When the closure is opened the flap separates from one of the sections.

7 Claims, 4 Drawing Sheets

FLIP TOP CAP WITH TAMPER EVIDENT FLAP

BACKGROUND OF THE INVENTION

1. FIELD OF INVENTION

This invention relates to a flip top closure with a tamper evident flap thereon, said flap being severed when said closure has been opened.

2. DESCRIPTION OF THE PRIOR ART

Flip top closures are known and it is known to have tamper evident flip top closures where a diaphragm is located inside the closures, the diaphragm being connected to a finger loop so that the diaphragm can be removed. One of the difficulties with the prior art closure is that the diaphragm is located within the closure itself. When consumers are purchasing products containing the flip top closure, they often do not lift the flip top before completing the purchase. Upon arriving at their residence, consumers will likely not open the flip top until such time as they wish to begin to use the product within the container. At that stage, the consumer observes for the first time the diaphragm within the flip top closure. If there is evidence that the diaphragm has been tampered with, it is extremely inconvenient for the consumer to return the product at that time and it is also much more troublesome for the retailer to accept the return due to the large lapse in time. Often the consumer will no longer have a receipt for the product and while the retailer may not have any legal obligation to accept the return of the product, they may be forced to do so so as not to suffer from damaged goodwill.

SUMMARY OF THE INVENTION

It is an object of the present invention to provide a tamper evident flip top closure where the tamper evident component is highly visible externally of the closure. It is a further object of the present invention to provide a tamper evident flip top closure where evidence of tampering is highly visible externally of the closure.

A tamper evident flip top pouring closure is used with a container having a neck with an opening therein, said neck having an outer surface with a screw thread and retention means for said closure thereon. The closure has a base section and an upper section connected to one another by a hinge. Each of said sections have a periphery with a lip extending thereon. When the sections are in a closed position, the lips form a continuous line of contact with one another. When the closure is in an open position, the lips are apart from one another. When the closure is in a closed position, a flap extends across said line of contact and is affixed to said upper section and to said lower section.

DESCRIPTION OF A PREFERRED EMBODIMENT

Figure 1:
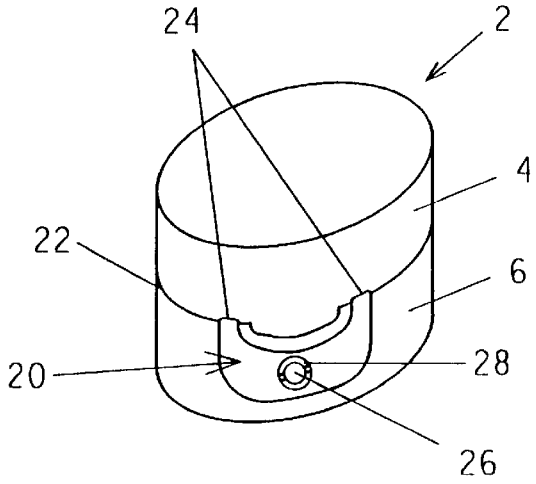
FIG. 1 is a perspective view of a flip top closure in a closed position with a flap affixed to an upper section and base section.
Figure 2:
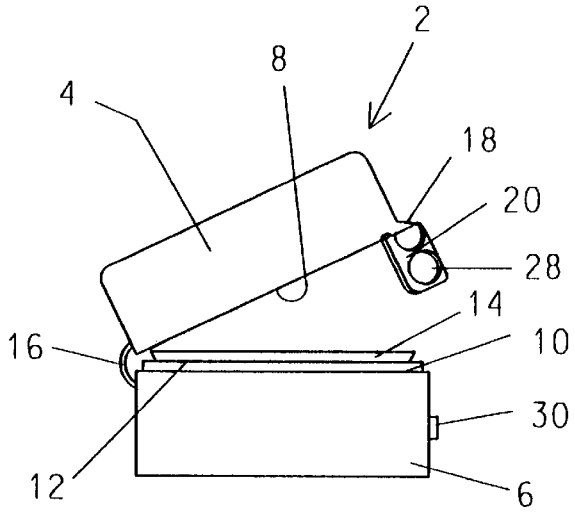
FIG. 2 is a side view of the closure of FIG. 1 in an open position with the flap affixed to the upper section.

In FIGS. 1 to 4, there is shown a tamper evident flip top pouring closure 2 having an upper section 4 and a base section 6. The sections 4, 6 each have a periphery with lips 8, 10 respectively as best shown in FIG. 2. The base section contains a vertical wall 12 located immediately inside of said lip 10 and seal 14 to receive a corresponding seal (not shown) within the upper section 4. The sections 4, 6 are affixed to one another by a hinge 16. An interior of the closure is conventional. The sealing diaphragm can be included in the interior of the closure, but is preferably omitted as it is not required as a tamper evident feature.

Figure 3:
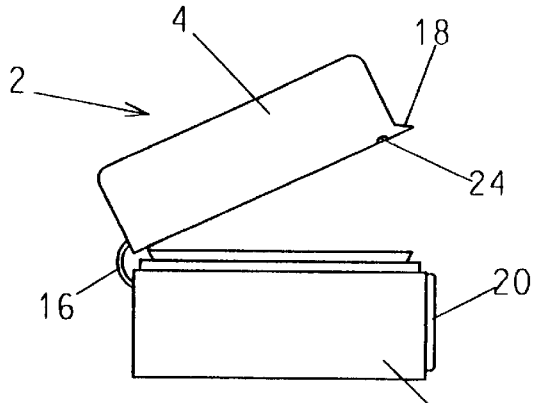
FIG. 3 is a side view of the closure of FIG. 1 in an open position with the flap affixed to the base section.

The lip 8 of the upper section 4 has an extension 18 thereon as best shown in FIG. 3 to provide gripping means for a finger of a user when it is desired to open or close the closure. When the closure is in a closed position as shown in FIG. 1, a flap 20 extends across a line of contact 22 and is affixed to the upper section 4 by hinges 24 and to the base section 6 by ultrasonic spot welding 26. Preferably, the flap 20 has a circle 28 located therein to make the flap easy to remove from the lower section 6.

As shown in FIG. 2, the closure 2 is in an open position with the flap 20 affixed to the upper section 4. A stub 30 of the flap 20 remains on the base section 6 and is the residue from the spot welding.

In FIG. 3, the closure 2 is in an open position and the flap 20 remains affixed to the base section 6. Residual pieces of hinge 24 remain on the upper section 4 but are severed from the rest of the flap 20.

Figure 4:
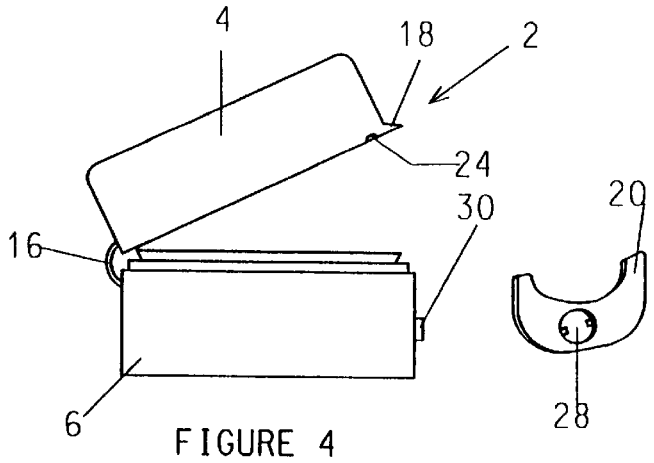
FIG. 4 is a side view of the closure of FIG. 1 in an open position with the flap removed entirely from said closure.
Figure 5:
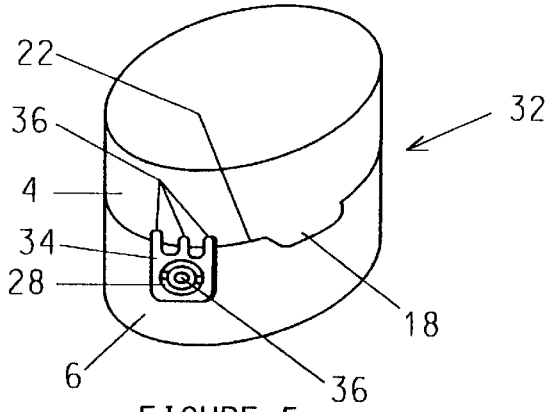
FIG. 5 is a perspective view of a further embodiment of the present invention with a flip top closure in a closed position and a flap affixed to said upper section and to said lower section on one side of said closure.

In FIG. 4, the closure 2 is shown in an open position and the flap 20 has been completely removed therefrom with only the stub 30 and residual hinges 24 remaining on the base section 6 and upper section 4 respectively.

In FIGS. 1 to 4, the same reference numerals are used throughout for the same components and each component is not necessarily separately described for each Figure.

In FIGS. 5 to 8, there is shown a further embodiment of the invention. Those components that are identical to the components of FIGS. 1 to 4 are described using the same reference numerals as those used for FIGS. 1 to 4. A closure 32 is shown in a closed position in FIG. 5 with a flap 34 extending across a line of contact 22 between the two sections 4, 6. It is affixed to the upper section 4 by hinges 36 and affixed to the base section 6 by spot welding at point 38. The flap 34 has a different shape than the flap 28 and is located on a side of the closure 32 between the extension 18 and the hinge 16.

Figure 6:
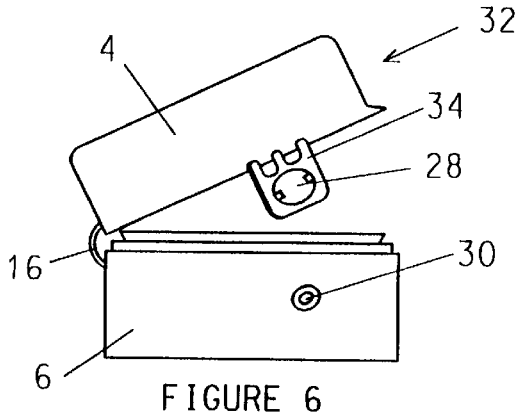
FIG. 6 is a side view of the closure of FIG. 5 in an open position with the flap affixed to the upper section.

In FIG. 6, the closure 32 is shown in an open position with the flap 34 remaining affixed to the upper section 4 with only the stub 30 from the spot welding remaining on the lower section 6.

Figure 7:
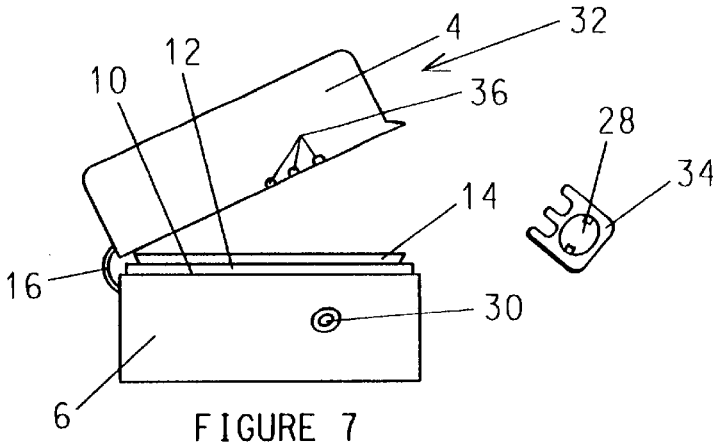
FIG. 7 is a side view of the closure of FIG. 5 in an open position with the flap removed entirely from the closure.

In FIG. 7, the closure 32 is shown in an open position and the flap 34 is shown to be completely removed therefrom except for the stub 30 from the spot welding on the base section 6 and the residue from the hinges 36 on the upper section 4.

Figure 8:
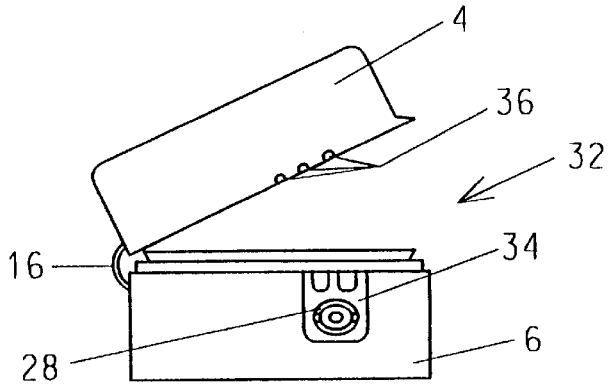
FIG. 8 is a side view of the closure of FIG. 5 in an open position with the flap affixed to the base section.

In FIG. 8, the closure 32 is shown in an open position with the flap 34 affixed to the base section 6 and residue of the hinges 36 on the upper section 4.

Figure 9:
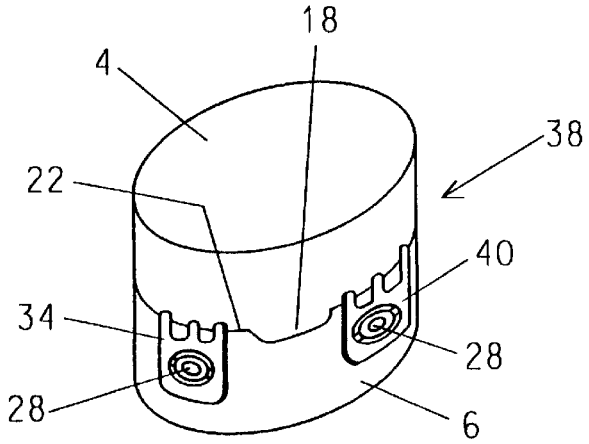
FIG. 9 is a perspective view of a further embodiment of the invention with a flip top closure in a closed position with two flaps affixed to an upper section and to a lower section, said flaps being located on either side of an extension.

In FIG. 9, there is shown a further embodiment of a closure 38 in a closed position. The flap 34 is a first flap and is located on one side of the extension 18 and a second flap 40 is located on an opposite side of the extension 18. The same reference numerals are used in FIG. 9 as those used in FIGS. 5 to 8 for those components that are identical to those of FIGS. 5 to 8. Of course, when the closure 38 is moved from the closed position shown in FIG. 9 to an open position (not shown) the second flap 40 can either remain affixed to the upper section 4, the base section 6 or be completely removed from the closure just like the first flap 34 (see FIGS. 6 to 8).

Figure 10:
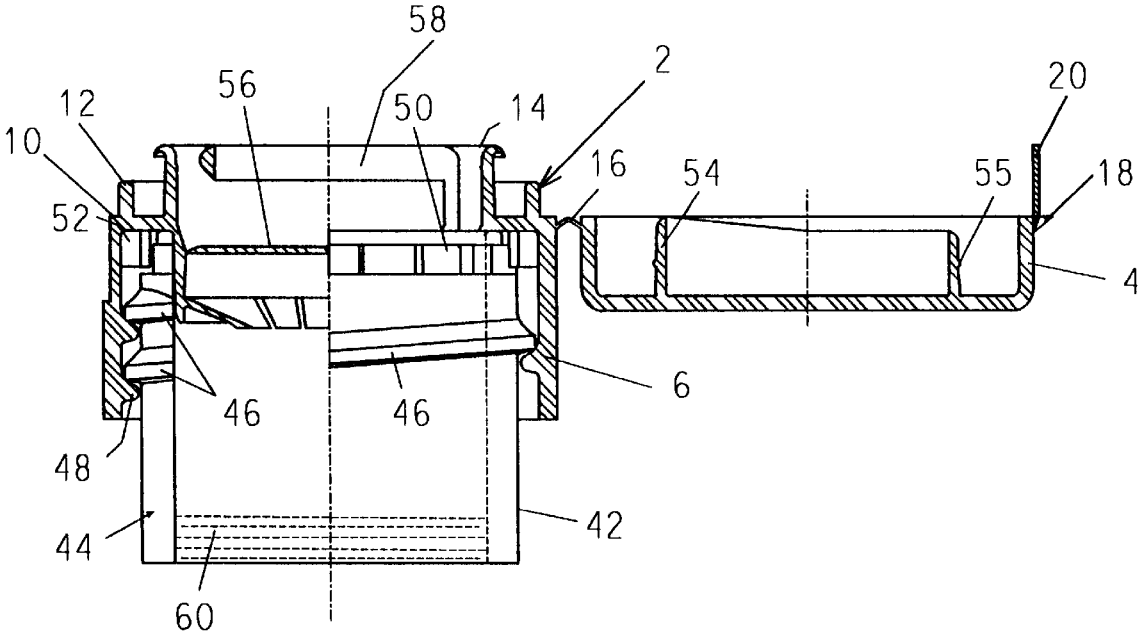
FIG. 10 is a sectional side view of a flip top closure in an open position on a container.
Figure 11:
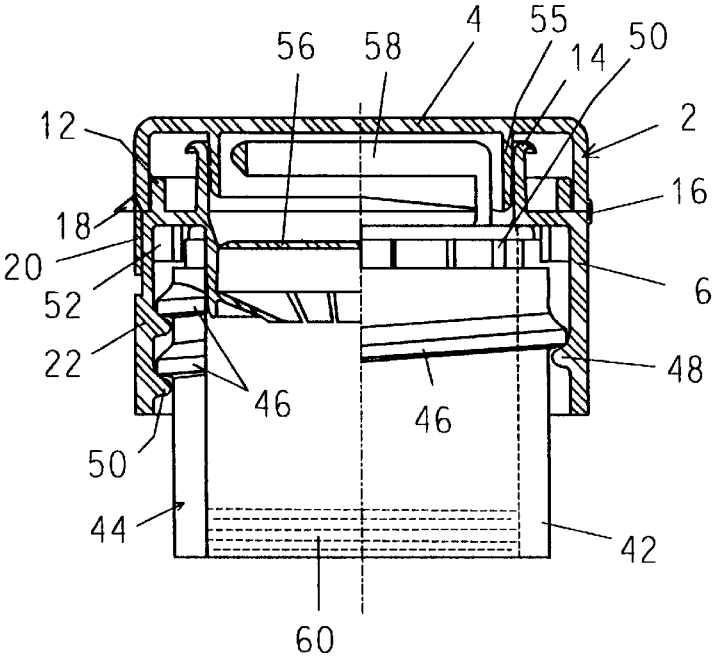
FIG. 11 is a sectional side view of a flip top closure in a closed position on a container.

In FIGS. 10 and 11, there is shown a sectional side view of the closure 2 mounted on a neck 42 of a container 44. The neck has screw threads 46 thereon corresponding to screw threads 48 on the closure. Interlocking means 50, 52 on the container 42 and closure 2 respectively prevent the screw threads from being opened once the closure is turned tightly onto the container 42. The screw threads 46 and the interlocking means 52 of the container 42 provide retention means for the container. The screw threads 48 and interlocking means 50 of the closure 2 provide corresponding retention means for the closure 2. When the closure has been tightened on to the container, the interlocking means 50, 52 prevent the closure from being removed without destroying or at least damaging the closure. All of the closures shown in FIGS. 1 to 9 would preferably have the same retention means as those shown in FIGS. 10 and 11. The same reference numerals are used in FIGS. 10 and 11 as those used for FIGS. 1 to 4 for those components that are identical to those of FIGS. 1 to 4. A seal 54 in the upper section 4 fits within the seal 14 of the base section 6 when the closure 2 is in a closed position as shown in FIG. 11. The seal 54 has a ridge 55 thereon to create a better seal. The closure shown in FIGS. 10 and 11 contains a diaphragm 56 with a finger loop 58 that is conventional and is designed to be removed when a consumer wishes to have access to a product 60 within the container 42. The flap of the present invention can be used with closures that do not have a diaphragm as the flap can replace the diaphragm on the tamper evident component.

Numerous variations within the scope of the attached claims will be readily apparent to those skilled in the art.

We claim:

1. A tamper evident flip top pouring closure for use with a container having a neck with an opening therein, said neck having an outer surface with retaining means for said closure thereon, said neck having interlocking means thereon, said closure comprising a base section and a upper section, said upper section having a lip extending along a lower edge thereof and said base section having a lip extending along an upper edge thereof, said sections being in a closed position when said lips form a continuous line of contact with one another, said sections being in an open position when said lips are apart from one another, when in a closed position said closure having a flap extending across said line of contact of said lips and being affixed to each of said upper section and said base section, said flap being severable from one of said sections when said closure is moved from a closed position to an open position, said flap leaving a readily noticeable residue on said section from which said flap is severed, said base section having retaining means thereon corresponding to the retaining means on said container, said base section having interlocking means corresponding to the interlocking means on said container, said interlocking means preventing said closure from being removed after said closure is installed on said container, said interlocking means being located above said retaining means, said upper section has an extension on said lip in an area adjacent said flap, said extension serving as a handle to open said closure.

2. A flip top closure as claimed in claim 1 wherein said closure is formed from molded plastic and said flap is affixed to an upper section by a first hinge and spot welded to said base section.

3. A flip top closure as claimed in claim 2 wherein said upper section and said base section being interconnected by a second hinge, said flap being affixed to said upper section on either side of said extension.

4. A closure as claimed in means, said upper section has an extension on said lip in an area adjacent said flap, said extension serving as a handle to open said closure the flap is a first flap and there is a second flap located between said extension and said second hinge on a side of said closure opposite to said first flap.

5. A closure as claimed in any one of claim 2, 3 or 4 wherein the residue is selected from the group of part of said first hinge for said flap and a spot where the flap has been welded.

6. A closure as claimed in claim 2 wherein said flap has a face with at least a partial circle formed therein, said flap being spot welded within said circle, said circle breaking away from said flap when said closure is moved from a closed position to an open position.

7. A closure as claimed in claim 2 where in said flap affixed to said upper section by plastic molding.

* * * * *